United States Patent [19]

Matsumura

[11] 4,188,894

[45] Feb. 19, 1980

[54] HAIR ROOTING APPARATUS WITH ITS HOOKED NEEDLE MOVING ALSO TRANSVERSELY

[75] Inventor: Yoshitsugu Matsumura, Nara, Japan

[73] Assignee: Kanegafuchi Chemical Industry Co., Ltd., Osaka, Japan; a part interest

[21] Appl. No.: 749,613

[22] Filed: Dec. 10, 1976

[51] Int. Cl.[2] ..... D05B 23/00

[52] U.S. Cl. ..... 112/156; 112/79.5; 289/2

[58] Field of Search ..... 112/79.5, 79 R, 156, 112/3, 170; 132/5; 289/2, 16

[56] References Cited

U.S. PATENT DOCUMENTS

| | | | |
|---|---|---|---|
| 819,953 | 5/1906 | Thompson | 289/2 X |
| 857,941 | 6/1907 | Horton | 112/156 |
| 1,855,541 | 4/1932 | Bamkin | 112/156 |
| 3,882,804 | 5/1975 | Matsumura | 112/79.5 |

*Primary Examiner*—H. Hampton Hunter
*Attorney, Agent, or Firm*—Wenderoth, Lind & Ponack

[57] ABSTRACT

In rooting hair or similar substances on the surface of a material such as a woven or knitted fabric or a yarn or an elastic material by means of a sewing machine hooked needle, in the manufacture of wigs, false eyelash or long pile fabrics, the hooked needle goes through the material, goes down, hooks hair for rooting, and goes up again above the upper part of the material. In this case, the hooked needle goes up and down simultaneously with its reciprocating movement in a direction at right angles to the direction of the material movement, that is, in a transverse direction.

6 Claims, 17 Drawing Figures

1
2
3
4
5
6
7
8
9
10
11
12
13
14
15
16
17
18
19
20
21
22
23
24
28
32
35
50

10

HAIR ROOTING APPARATUS WITH ITS HOOKED NEEDLE MOVING ALSO TRANSVERSELY

BACKGROUND OF THE INVENTION AND PRIOR ART

A mechanical apparatus for the manufacture of wigs and similar substance has been hitherto studied in various ways and invented by the present inventor, and U.S. Pat. No. 3,882,804 has been granted on that invention. In the invention of that patent, a hooked needle goes up and down simultaneously with its movement in a direction parallel to the movement of a material in which hair is to be rooted. In the event of rooting hair on a fabric with coarse texture or on a single yarn or on a finer subtance similar to single yarn, there is sometimes a case in which the hooked needle goes down to an interstice among yarns of the material or to a place where there is no single yarn, so that no knot is tied in such a case. In other words, there sometimes occurs an imperfect hair rooting. Thus, the apparatus of the above invention has a defect in that there are limitations as the material which maybe used for hair rooting.

There is another defect in the apparatus of the above patent. As the positions of the hooked needle for making knots advances parallel to the a direction in which the material moves, the rooting of hair is restricted by intervals at which the hooked needle advances. Thus, it is impossible to make the density of hair rooting denser than that. There is also the following defect. In the second up and down operation of the hooked needle, the hair loop formed by its first up and down operation is likely to be accidentally hooked by the hooked needle which is going up through the hair layer, and is thereby broken.

BRIEF SUMMARY OF THE INVENTION

In rooting hair on the surface of a material such as a woven or knitted fabric or a yarn or an elastic material by means of the hooked needle of a sewing machine in the manufacture of wigs, false eyelashes or long pile fabrics, the hooked needle goes through the fabric and goes down, hooks hair and goes up over the upper part of the fabric. The hooked needle goes up and down simultaneously with its reciprocating movement in a direction at right angles to the direction of the fabric, that is in a transverse direction.

By so doing, it is possible to prevent the failure of rooting hair on the material (The hooked needle with its rooting hair goes up the upper part of the material without knotting the hair to the material, that is the condition in which the hair comes off.) Thus, this invention ensures satisfactory rooting of hair on the material. Besides, as the hooked needle makes a transverse reciprocating movement, it is possible to reduce the size of knots to whatever size is desired. Moreover, by adjusting the quantity of the material to be fed, it is possible to adjust the density of hair rooting as desired. Furthermore, the apparatus of the invention makes it possible to tie reliable knots such as double knots.

BRIEF DESCRIPTION OF THE DRAWINGS

Attached drawings show a preferred embodiment of this invention. In the drawings:

FIG. 6A shows the state in which the hooked needle, after its first descent, is about to pick up hair.

FIG. 6B shows the state in which the hooked needle, while moving transversely, is about to begin its second descent after having formed a first hair loop by its first ascent.

FIG. 6C shows the state in which the hooked needle is about to go up after having made its second descent, pressed the said first loop hair flat with the pressing device, and hooked a hair end portion.

FIG. 6D shows the state in which the hooked needle is about to start its third descent after having formed a second hair loop by its second ascent.

FIG. 6E shows the state in which the hooked needle is about to go up after having made its third descent, pressed the said second hair loop flat with the pressing device, and hooked a hair end portion.

FIG. 6F shows the state in which the hooked needle pulls up the hair end portion through the said second hair loop, and a cam inclines a control lever and pulls up the pressing device further so that the edge of the hooked needle is released therefrom.

FIG. 6G shows the state in which the hair end portion is about to get out of the hooked needle after having been pulled up upwardly.

OBJECTS OF THE INVENTION

Figure 1:
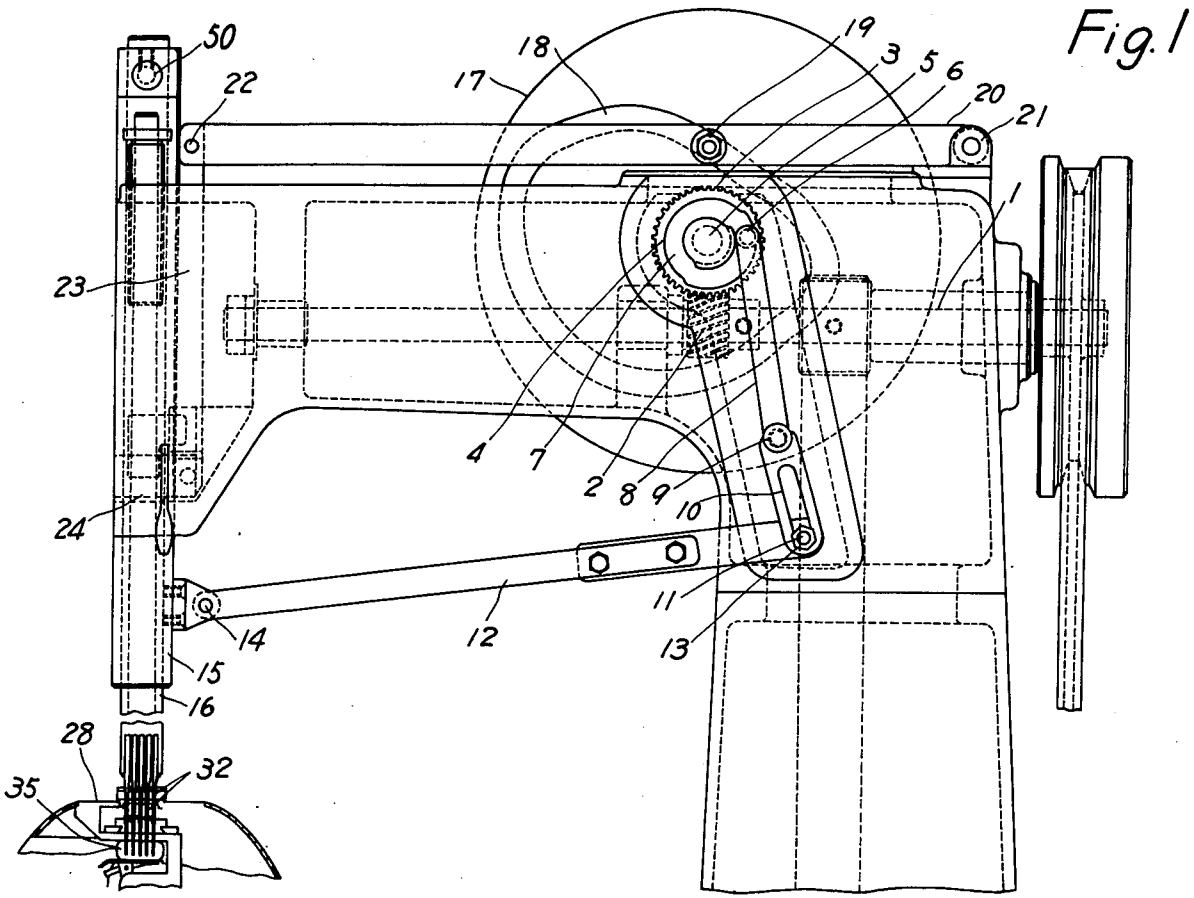
FIG. 1 is a side elevation of the principal parts of the apparatus.

An important object of the invention is to provide a mechanical hair rooting apparatus which is capable of reliably rooting on a material having wide interstices, such as a net-like material or yarn.

A second object is to provide a mechanical hair rooting apparatus which is capable of adjusting the density of hair rooting as desired.

A third object is to provide a mechanical hair rooting apparatus which is capable of removing the following defect. When the hooked needle goes up through a hair loop formed on the surface of a material by its up and down movement, it tends to hook and break the hair loop. Such a defect is caused by the fact that the hair loop is inclined slantingly and upwardly, and its inside is narrow.

A fourth object is to provide a mechanical hair rooting device easily capable of producing reliable double knots from single knots by exchanging cams for ascending and descending a needle supporting bar.

DETAILED DESCRIPTION OF THE INVENTION

A looper under a material is operated by a procedure generally available to the public, and a material is allowed to move intermittently in its advancing direction by means generally available to the public, while a place to which the hooked needle goes down is allowed to move in a direction at practically right angles to the advancing direction of the fabric, that is in a practically transverse direction, and the up and down movement of the hooked needle is simultaneously associated with transverse movement.

Such complex operation of both movements ensures hair rooted directly to a fabric or hair rooted to a yarn attached to a net-like material. With the use of an elastic material, it is possible to manufacture a wig which fits any head. Also it is possible to root hair on even a single yarn. It is further possible to use the mechanical hair rooting apparatus for making a false eyelash, which requires delicate work. Unlike the restriction placed on the density of rooting hair by the movement of the hooked needle in a direction parallel to the advancing direction of a fabric, the transverse reciprocating movement of the hooked needle of this invention allows the density of rooting hair to be adjusted as desired.

Referring to the drawings, the numeral 1 designates a main shaft of a sewing machine. A gear 2 is fixed to the main shaft. The gear 2 engages at right angles a gear 3. A cam 4 for a transverse movement is provided on a rotating shaft 5 of the gear 3 so that the gear 3 and the cam 4 may rotate on the same shaft 5. A cam roller 6 is provided to fit into a cam groove 7. The cam roller 6 is provided at the base end of a sliding lever 8, which is pivoted at a fulcrum 9. A shaft 11 is adjustably provided by means of a long hole 10 at the other end of the lever 8. A connecting bar 12 has the shaft 11 at its basic end. The shaft 11 is furnished with a nut 13 in such a manner that its furnished position can be adjusted up and down within the long hole 10. The other end of the connecting bar 12 is fixed at 14 to a supporting frame 15 and oscillates with an upper fulcrum 50 as a base end. A needle bar 16 fits into the supporting frame 15 in such a manner as to be allowed to go up and down freely. A cam 17 for up and down movement has a cam groove 18 on its side. The cam 17 and the cam 4 are provided on the same shaft 5. A cam roller 19 is attached to the side of a lever 20 which is pivoted at a fulcrum 21. The other end of the lever 20 is attached at 22 to an ascending and descending bar 23. The ascending and descending bar 23 connects with the needle bar at a connecting portion 24.

Figure 6A:
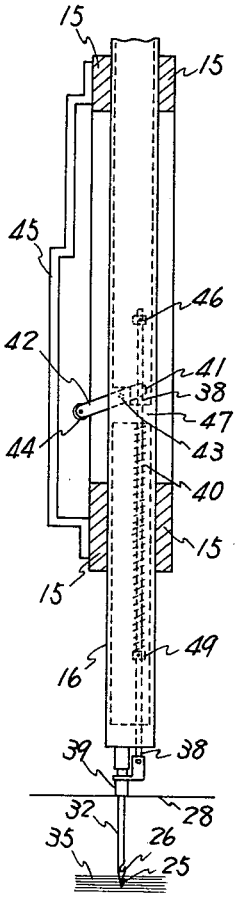
FIGS. 6A–6G are side views of the principle elements, showing the process of two knots being made.
Figure 6B:
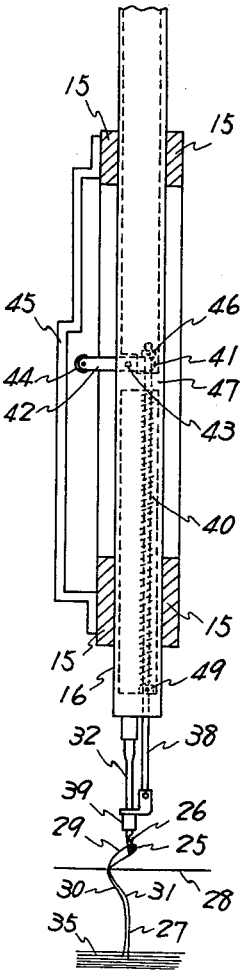
Figure 6C:
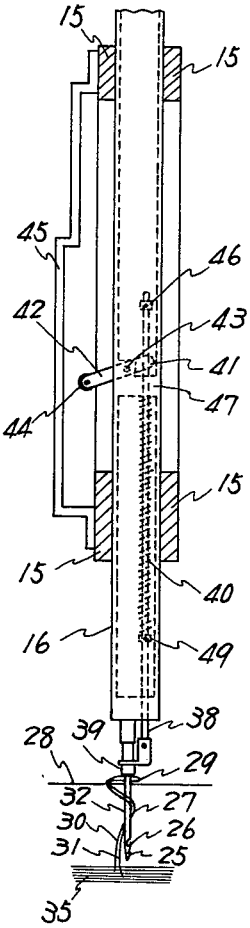

This invention has such construction as described above. In operation, the main shaft 1 is rotated. By the operation of the cam 17 for an up and down movement, a complex up and down movement is repeated, during which movement the needle bar 16 is raised and lowered more than one or two times and finally is raised higher. Also by the operation of the cam 4 for a transverse movement, the needle bar 16 moves left and right while needling. That is to say, a complex movement consisting of left and right, and up and down movements is imparted to a hooked needle on the needle bar 16. A hooked needle 32 has a lower and smaller hook 25 and an upper and larger hook 26 (FIG. 6). As shown by a portion from 0° to 30° in the abscissa in FIG. 2, the hooked needle 32 is allowed to make the first descent to −30 in the ordinate. This descent is the greatest descent in accordance with the shape of a cam groove 18, so that the lower and smaller hook 25 can penetrate into the hair bundle 35.

Figures 2, 3:
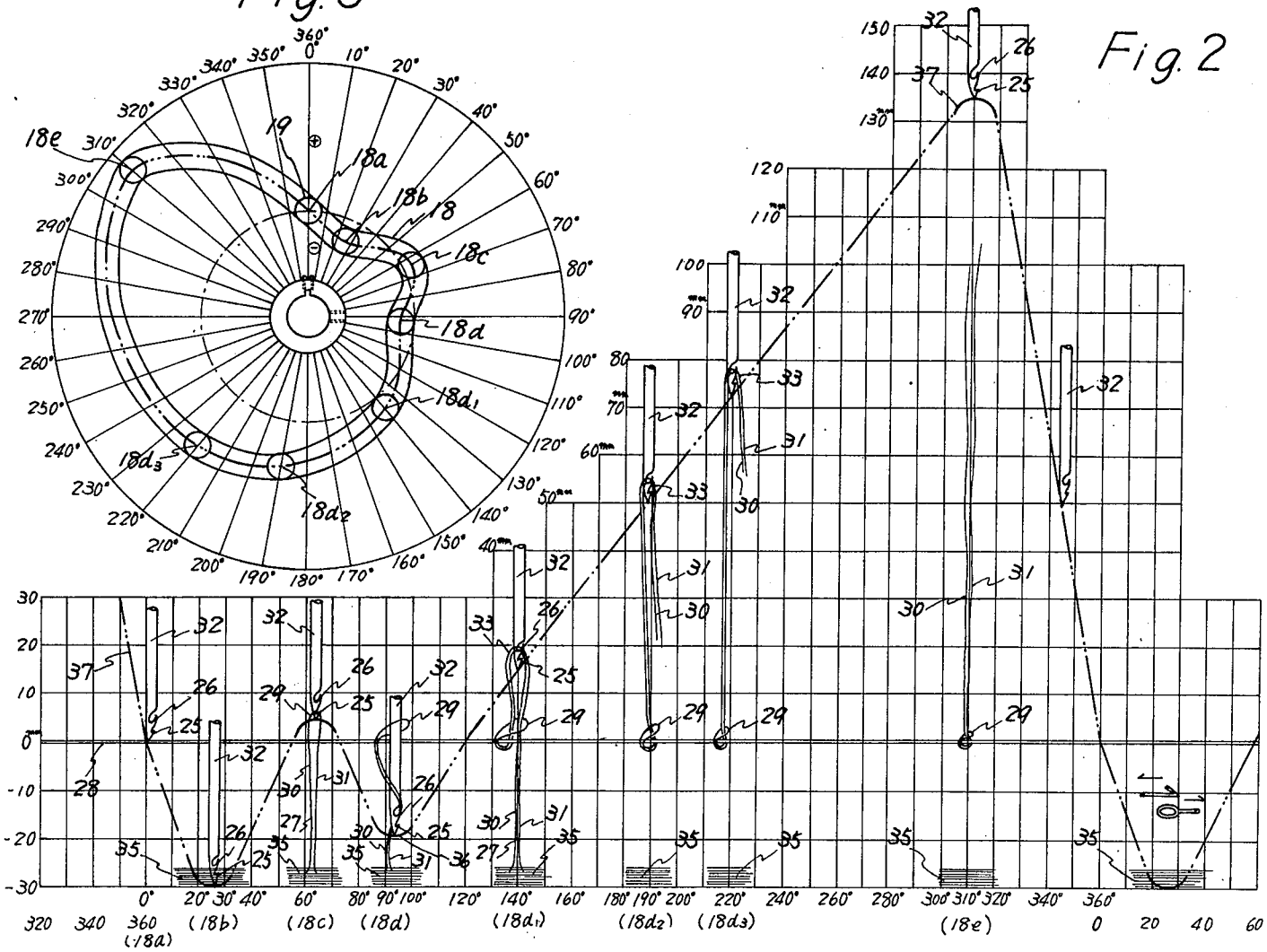
FIG. 2 is a chart showing the movements of a hooked needle and hair in the event of a single knot.
FIG. 3 is a schematic front elevation of a cam for allowing the hooked needle to go up and down when a single knot hair rooting is made.
Figure 4:
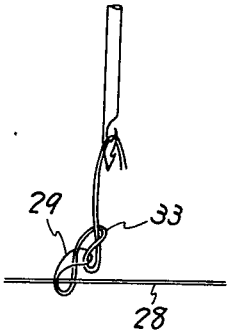
FIG. 4 is a side elevation when a double knot hair rooting is made on a single yarn.

As shown by a portion from 30° to 60° in the abscissa in FIG. 2, the hooked needle is allowed to make a slight ascent to about 5 in the ordinate. By this slight ascent of the hooked needle 32, its lower and smaller hook 25 picks up a long hair 27 below the material 28 and folds it into two knottable portions 30, 31, and lifts it up above the material 28. These two portions are not necessarily required to be equal. In this case, the upper and larger hook 26 of the hooked needle 32 does not go below −25 where the hair bundle lies even at the point of the great descent of the hooked needle 32, and is always above the hair bundle 35; it is not likely that the upper and larger hook 26 picks up the long hair.

Next, as shown by a portion from 60° to 90° in the abscissa in FIG. 2, the hooked needle 32 is allowed to turn downwardly in accordance with the shape of the cam groove 18. Here the hooked needle 32 is in the state of being lifted up, and a change in the shape of a cam 4 for a transverse movement which rotates together with the gear 3 on the same shaft 5 will impart a transverse movement to the supporting frame 15 through the cam roller 6, the lever 8, and the connecting bar 12, and this transverse movement will in turn cause the needle bar 16 supported by the supporting frame 15 to move transversely—a transverse direction relative to a direction in which the material advances—in other words the hooked needle 32 moves in a direction in which its hooks project. In this case, the hooked needle 32 is allowed to start to descend at a point where it has moved transversely. Here the inventor uses a well known device of his invention as already disclosed in his U.S. Pat. No. 3,882,804 (hook hole *7a*, hook hole *7b*). The operation of this device allows the two end portions to move transversely by describing a slight curve in a direction in which the hooked needle advances.

When the hooked needle 32 has descended from its transversely moved point, the two end portions 30, 31 are waiting substantially at a descending point of the hooked needle 32. As has been described before, the degree of the descent of the hooked needle depends on the shape of the related portions of the cam groove 18. Thus, if one designs the cam groove 18 so that the hooked needle 32 descends with its upper and larger hook 26 slightly below the place where the two end portions 30, 31 lie, that is up to −20 in the ordinate, the larger hook 26 will never fail to pick up the two end portions 30, 31. After the upper and larger hook 26 picks up the two end portions 30, 31, the hooked needles 32 ascends, together with its larger hook 26 holding the two end portions 30, 31, and its lower and smaller hook 25. Thus, it is unlikely that the two end portions will be caught by the smaller hook 25. In addition, the descent of the hooked needle 32 this time is such that its larger hook 26 is just above −20 in the ordinate, and so this degree of its descent does not allow its smaller hook 25 to penetrate into the hair bundle 35, as may be seen in FIG. 6C. Thus, in this second and shorter descent of the hooked needle 32, it is not likely that the hair bundle 35 is caught by the small hook 25.

Such hair rooting of one knot is suitable for a thin rooting in an area such as the surrounding area or portion near the circumference or edge of a wig. When rooting hair in the area near the central area of a wig where rooted hair tends to fall out, it is preferable to have a double knot to prevent the knotted portion of a rooted hair from loosening. In order to do this, it is necessary to form a second hair loop 33, allow the end portions 30 and 31 to pass through it again, and thereby repeat the intertwining.

Figure 9:
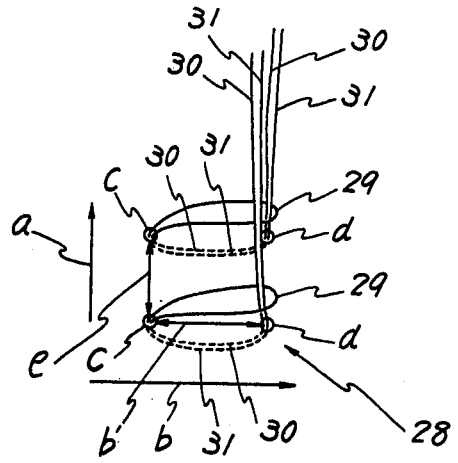
FIGS. 9 and 10 show the transverse movement of the needle and the engagement of the hook with the end portions of the hair loop.
Figure 10:
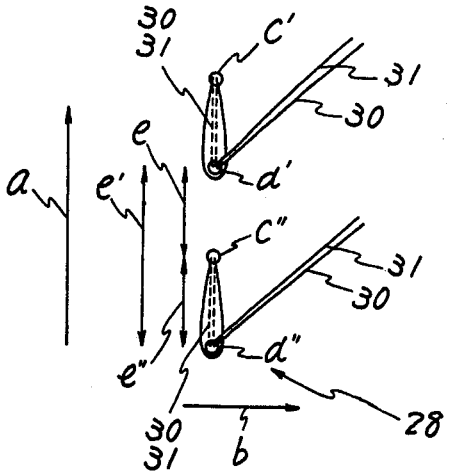

To more completely illustrate the knotting process, FIGS. 9 and 10 are provided. As the hooked needle 32 moves transversely, as a result of the motion of the cam lever 8 and the connecting rod 12 attached to the support frame 15, the needle moves a distance b relative to the direction a in which the material is moving. The first descending and ascending point c of the hooked needle 32 is different from its second descending and ascending point d. While the hair loop 29 is being lifted above the material 28 by the first ascent of the hooked needle 32, the two end portions 30, 31 move along the dotted lines below the material 28. When the hooked needle 32 makes the second descent, the two end portions, underneath the material 28, are lifted up at the ascending point d. Since the hooked needle is always within the loop 29, the end portions will be raised through the loop to form the knot. With the transverse and vertical movements of the hooked needle 32 the two end portions 30, 31 move along the dotted line below the material 28 and go upwardly through the loop 29 above the material.

If there were no transverse movement of the hooked needle 32, the hair loop 29 and the two end portions 31 would ascend and descend at the same point, and there would be no movement to create the slight curve under the material 28 so that the hair would come off the lower hook. The hooked needle 32 performs the first rooting by first descending and then ascending then moving transversely and then descending and then ascending again. During the procedure, the material 28 remains stationary on the sewing machine. At the time when the operation of the hooked needle has been completed, the material 28 then advances by one pitch. (This is a well known feature available on many sewing machines.) Then, while the operations of the hooked needle are again performed, the material remains stationary.

Figure 6D:
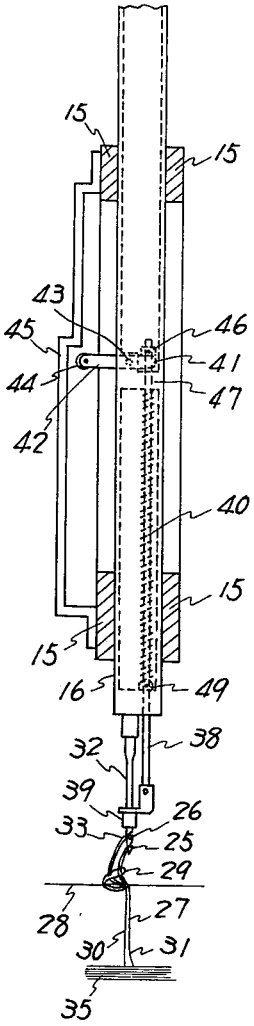
Figure 6:
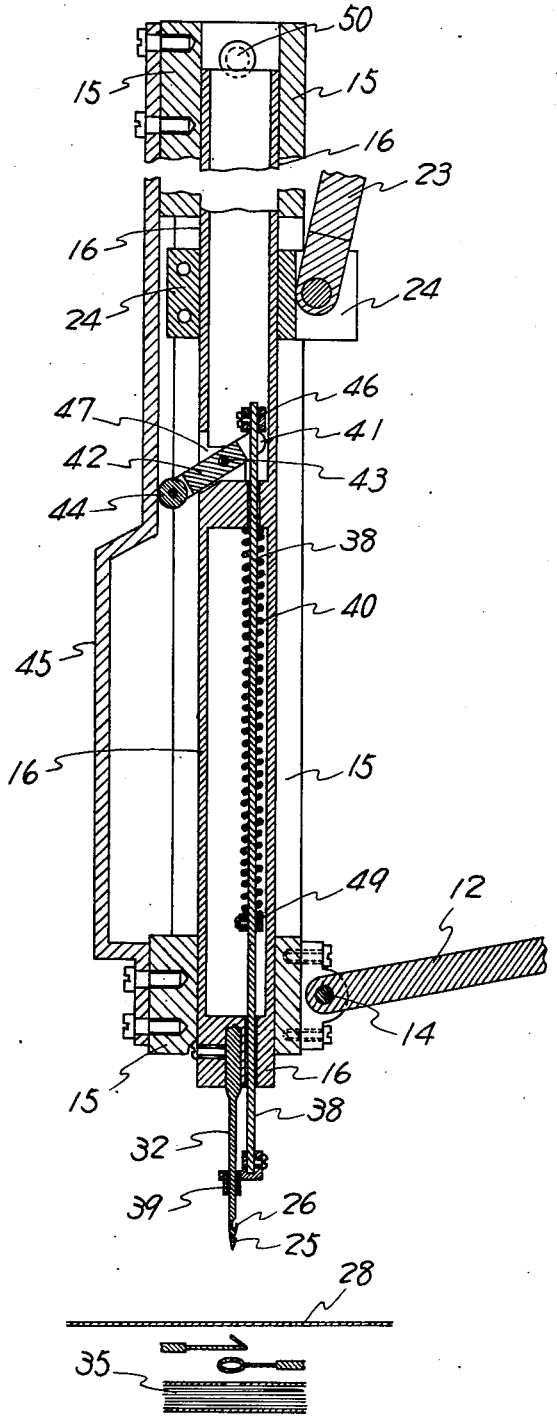
FIG. 6 is a sectional view of a needle provided with a pressing device.
Figure 6E:
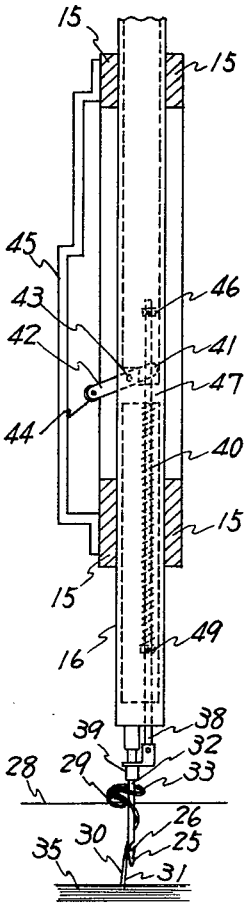
Figure 6F:
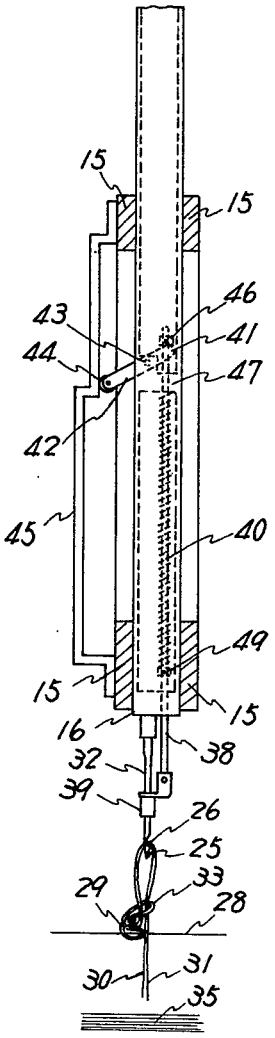
Figure 6G:
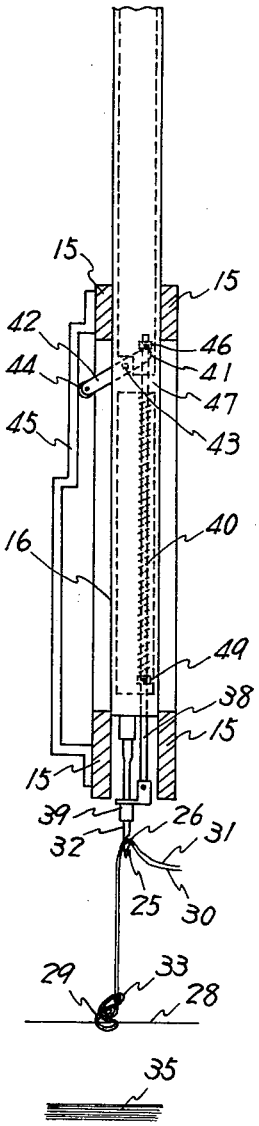

When the double knot is being formed, it simply requires a third descent and ascent of the hooked needle as shown in FIGS. 6E–6G.

Figure 5:
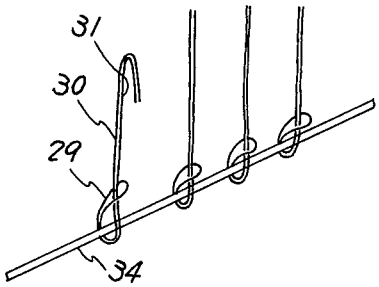
FIG. 5 is a perspective view when a single knot hair rooting is made.

A simple yarn 34 maybe used instead of a fabric for rooting hair, for example during the making of eyelashes. The hooked needle is reciprocated on both sides of the yarn 34 to obtain narrow linear hair rooting as illustrated in FIG. 5.

FIGS. 2 and 3 show the relations between the up and down movement of the cam 17 and the hooked needle which goes up and down. When the cam roller 19 comes to point 18*a* in the cam groove 18 (also shown on FIG. 2 as (8*a*)), the hooked needle 32 is just in contact with the material 28. When the cam roller 19 moves to point 18*b*, the hooked needle 32 reaches inside a hair bundle 35 after passing through the material 28. When the cam roller 19 comes to point 18*c*, the hooked needle 32 folds down a hair at a central point and hooks it by the lower and smaller hook 25 of the hooked needle 32, returns upward through the material 28, and exposes the hair loop 29 consisting of the folded portions 30, 31 above the surface of the material 28. In this case the hooked needle 32 is moved slightly in a transverse direction by the transverse movement of cam 4.

When the cam roller 19 comes to point 18*d*, the hooked needle 32 passes through the material 28 again and descends to a depth 36 which is a little short of reaching the hair bundle 35. At this point the upper and larger hook 26 of needle 32 to hooks the end portions 30 and 31 which have been previously folded into two and starts again to ascend and continues to ascend until the cam roller 19 comes to point 18*e*. During this time, the end portions 30 and 31 pass through the hair loop 29, which is reduced in size by being pulled upwardly, to complete hair rooting. The numeral 37 in FIG. 2 is a locus of the edge of the path of the hooked handle 32.

As shown in FIGS. 6A to 6G, this invention is provided with a device which prevents the hair loop from being broken. This device prevents a hooked needle, while ascending, from hooking and breaking a hair loop which has been formed during the first or second ascending and descending motions of the hooked needle. The construction of the device will be described hereinbelow. An ascending and descending bar 38 goes up and down through the needle bar 16 and a bridge 60 therein which supports the hooked needle 32. Attached to the lower end of the bar 38 is a pressing device 39 which surrounds of the hooked needle 32. Preferably, the pressing device 39 is made from a spring or rubber circular substance or a pipe. The control lever 42 is rotatably attached near the base end 43 thereof to the needle bar 16. At the base end of the control lever 42 is an opening 41 through which the upper section of the ascending and descending bar 38 passes. A cam roller 44 is rotatably attached to the other end of the control lever 42. A cam 45 is secured to the supporting frame 15 which is fixed to the frame and which supports the needle bar 16 in such a manner as to allow it to go up and down unrestrictedly. Thus, when the needle bar 16 goes up, the cam roller 44 comes in contact with the cam 45, which causes the control lever 42 to incline with its end having the cam roller 44 at a lower place. A clasp 46 is fixed at the upper end of the ascending and descending bar 38. When the central lever 42 inclines with its base end, the base end comes into contact with the clasp 46. The inside of the needle bar 16 has a supporting material 47. The upper section of the ascending and descending bar 38 slidably passes through this supporting material 47.

A stopping element 49 is provided in the lower section of the ascending and descending bar 38, and a spring 40 is interposed between the stopping element 49 and the supporting material 47.

The device for preventing hair loop from being broken has such a construction as has been described hereinabove. As shown in FIGS. 6A and 6B, the lower and smaller hook 25 hooks a hair out of the hair bundle 35, and with the ascending of the needle bar 16, the hooked needle goes up with the hair being hooked and forms a first hair loop. As shown in FIG. 6C the needle bar 16 descends again with the operation of the sewing machine, and the ascending and descending bar 38 also provided on the needle bar 16 descends with it. Thus, the pressing device 39 on the lower end of the ascending and descending bar 38 also descends. In this case, the hair loop 29 is formed above the material 28 around the hooked needle 32 by the first ascending thereof. With the descending of the pressing device 39, the hair loop 29 is pressed flat against the surface of the material 28 by the lower portion of the pressing device 39, thereby preventing the hair loop 29 from floating above the surface. The pressing device 39 is biased against the surface of the material 28; and while the needle bar 16 descends alone, the ascending and descending bar 38 is capable of staying on the surface of the material 28 because of the pressure of the spring 40, as shown in FIG. 6C. When the hooked needle 32 ascends with the end portions 30 and 31 hooked in its upper and larger hook 26, the ascending and descending bar 38 remains stationary due to the extension of the spring 40 until the lower end of the hooked needle 32 ascends to the level of the material 28, and the hair loop 29 continues to be pressed flat by the pressing device 39. (see FIGS. 6C and 6D). Thus, when the hooked needle 32 goes up through the inside of the hair loop 29, it will neither hook nor hurt the hair loop 29. Consequently, the purpose of this apparatus is achieved.

Figures 7, 8:
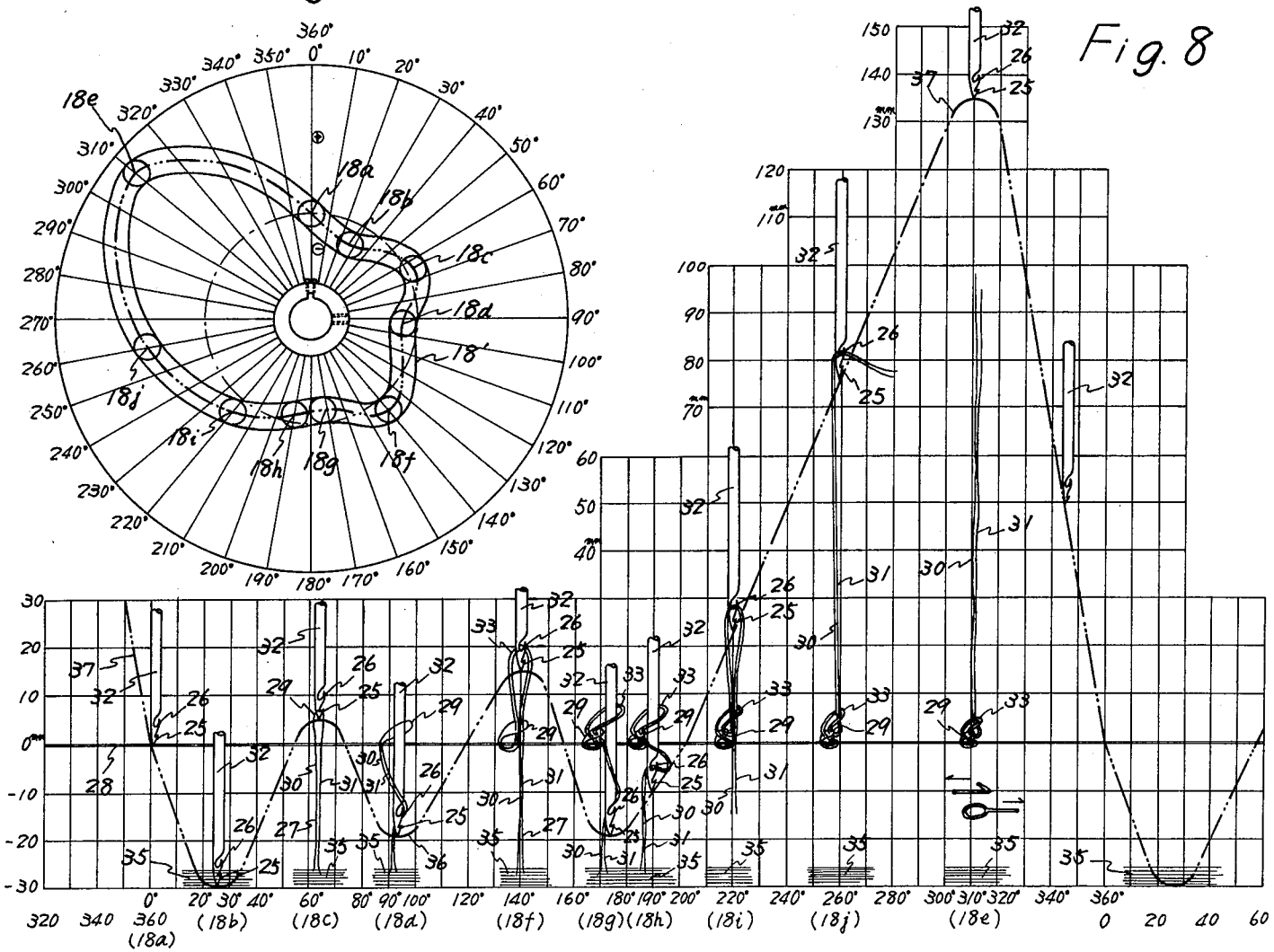
FIG. 7 is a schematic front view of a cam for ascending and descending the hooked needle in the case of forming the double knot.
FIG. 8 is a schematic drawing showing the movement of the hooked needles and the hair in the case of forming the double knot.

For a single knot, the needle bar 16 ascends further from the state shown in FIG. 6D, and pulls the end portions 30 and 31 upwardly. For a double knot, modifications are made to the cam groove 18 (see FIGS. 7 and 8) of the cam 17 for an up and down movement which is shown in FIG. 3, so as to enable the hooked needle 16 to make further movements as shown in FIGS. 6E to 6G. The first descent and ascent of the hooked needle 32 is simultaneous with its transverse movement; its second descent and ascent is followed by its third descent and ascent at the same point where its descent and ascent were performed.

With the second ascent of the hooked needle 32, the upper portions of the two end portions 30, 31 are raised. Because of this raising, the hair loop 29 formed during the first ascent of the hooked needle 32 is pulled and reduced in size, as shown in FIG. 6E, and lies somewhat on the left to the point below the hooked needle 32. Then, in accordance with the shape of a cam groove 18' for a descending and ascending movement in FIG. 7, the hooked needle 32 makes the third descent. In this case, the hooked needle 32 descends through the hair loop 33 again and descends further below the material 28 where the hooked needle 32 picks up the remaining end portions 30, 31 and raises it above the material 28 to complete a second knotting. In that instance the second hair loop 33 is pressed flat against the surface of the material 28 by the pressing device 39 which has descended as described hereinabove. And when the hooked needle 32 further ascends and goes through the inside of the hair loop 33 with the end portions 30 and 31 hooked by its hook, it will neither hook nor hurt the hair loop 33.

During the ascending of the ascending and descending bar 38, together with the ascending of the needle bar 16, the lower end of the hooked needle with the second end portions hooked in its hook is surrounded by the pressing device 39. Thus, there is the possibility that the end portions may not be easily removed from the hooked needle at the ascended end. But the control lever 42 which has been so far ascending in its horizontal form without coming into contact with the cam 45, suddenly contacts the cam 45, as shown in FIG. 6F, and the cam-roller 44 resisting the cam 45 suddenly inclines. Thus, the base of the control lever 42 pushes up the clasp 46 from below. By this pushing up operation, the ascending and descending bar 38 goes up slightly independently of the needle bar 16, and thereby the lower end of the hooked needle surrounded by the pressing device 39, is no longer surrounded, as shown in FIG. 6G. Now the hair end portions can be easily released from the hooked needle, for example, by blowing air against them. It may be added that it is possible to root hair by a machine on the surface of a more or less spherical material by making a slight modification to the design of a material feeding portion. This is nothing but another embodiment of this invention.

What is claimed is:

1. A device for knotting specific lengths of fibers onto a base material, said device comprising:

at least one double-hooked needle with a smaller hook at the lowest portion thereof and a larger hook on said needle above said smaller hook;

holding means for holding said needle, said holding means being comprised of:

a support frame, and a needle bar slidably fitted within said support frame with said needle connected to the bottom thereof, a rotatable drive shaft;

a first cam means operatively connected to said drive shaft and said needle bar for moving said needle bar vertically to varying predetermined heights and depths during the formation of each knot;

a second cam means operatively connected to said drive shaft and said support frame for moving said support frame and said needle therein transversely in the open direction of said smaller hook in a timed relationship with the movement of said first cam means; and a frame on which said holding means, said drive shaft and said two cam means are mounted;

whereby rotating said drive shaft simultaneously operates said first and second cam means so that said needle is moved to a lowest position beneath said base material and then raised to a first intermediate position above said material by said first cam means followed by said second cam means moving said support frame and said needle bar connected thereto transverse to the vertical movement of said needle when said needle is in said first intermediate position, then said first cam means at least one time lowers said needle beneath said base material a distance less than said lowest position followed by returning said needle vertically above said base material, and finally said support frame is returned by said second cam means to its original position by a reverse transverse movement when said needle is in its highest position above said base material.

2. An apparatus as claimed in claim 1, wherein said material is selected from the group of fabrics consisting essentially of woven fabric, netting, woven fabric having elastic yarn therein, inelastic yarn and elastic yarn, and wherein said fibers are knotted a plurality of times.

3. An apparatus as claimed in claim 1, wherein said first cam means is comprised of:

a first cam wheel operatively connected to said drive shaft for rotation therewith, said first cam wheel having a first cam groove therein;

a first pivoted lever pivotally connected at one end to said frame and at the other end to said support frame of said holding means; and a first cam roller on said first lever slidably fitted into said first cam groove, whereby rotating said first cam wheel causes said first cam roller in said first cam groove to raise and lower said first lever in accordance with the configuration of said first cam groove.

4. An apparatus as claimed in claim 1, wherein said second cam means is comprised of:

a second cam wheel operatively connected to said rotatable shaft for rotation therewith, said second cam wheel having a second cam groove therein;

a second cam roller slidably fitted into said second cam groove;

a sliding lever connected to one end to said second cam roller and pivoted to said frame along the length thereon, said sliding lever having a slot at the end opposite the end connected to said cam roller; and a connecting bar adjustably positioned in said slot at one end thereof and connected to said needle bar of said holding means at the other end thereof, whereby rotation of said second cam causes said sliding lever connected through said second cam roller to said second groove to pivot on said framework and thereby causes said connecting bar to move said needle bar of said holding means transversely.

5. An apparatus as claimed in claim 1, wherein:

said needle bar has a bridge section with an opening therethrough; and said holding means is further comprised of:

an ascending and descending bar mounted within and extending slidably through the bottom of said needle bar and said opening in said bridge section, a pressing device affixed to the bottom of said ascending and descending bar and surrounding said needle, a control lever rotatably attached to said needle bar at the mid-portion thereof, said control lever having an opening at one end surrounding said ascending and descending bar, upper and lower stopping elements spaced from each other on said ascending and descending bar, a spring between said bridge and said lower stopping element, a cam surface connected to one side of said support frame, and a cam roller rotatably affixed to the end of said control lever opposite the end of the opening therethrough, said cam roller being in contact with said cam surface.

6. An apparatus as claimed in claim 5, wherein said pressing device is resilient, circular and surrounds said needle.

* * * * *